United States Patent [19]

Komarov

[11] 4,067,073

[45] Jan. 10, 1978

[54] CONVERTIBLE SOFA AND METHOD FOR ASSEMBLING AND DISASSEMBLING SAME

[76] Inventor: Anatoli N. Komarov, 100-24 Erskine Place, Co-Op City, Bronx, N.Y. 10475

[21] Appl. No.: 713,905

[22] Filed: Aug. 12, 1976

[51] Int. Cl.[2] ..... A47C 17/14

[52] U.S. Cl. ..... 5/13; 5/18 R; 297/440

[58] Field of Search ..... 297/440; 5/12, 13, 17, 5/18, 51 K

[56] References Cited

U.S. PATENT DOCUMENTS

| | | | |
|---|---|---|---|
| 465,180 | 12/1891 | Johnson | 5/18 |
| 3,041,635 | 7/1962 | Holtzclaw | 5/18 R |
| 3,056,973 | 10/1962 | Keller et al. | 5/13 |
| 3,066,982 | 12/1962 | Bower | 297/440 |
| 3,348,244 | 10/1967 | Fasanella | 5/17 |
| 3,393,011 | 7/1968 | Shastid | 297/440 |
| 3,685,063 | 8/1972 | Morgan | 297/440 |

*Primary Examiner*—Casmir A. Nunberg

*Attorney, Agent, or Firm*—Bauer, Amer & King

[57] ABSTRACT

An assemblable and disassemblable, convertible sofa characterized by the concealment and, therefore, the visual absence of fasteners after the sofa has been assembled. Where two parts are to be joined, a metallic insert having internal and external threads is inserted into one of the parts to be joined. A screw passes through the other part to be joined and matingly engages the internal threads of the insert. In the assembled condition of the sofa, the arm rests are secured to a base frame by means of fasteners that extend in an outward direction from an internal portion of the base assembly of the sofa. The back wall of the sofa is similarly assembled. A sliding board is mounted on the top wall of the base assembly and is movable between the opened and closed positions of the sofa. In one embodiment of the invention, the sliding board is manually pulled forward from the closed to the open position and also manually reversed, while in an alternative embodiment of the invention, hydraulic means are used to move the sliding board between the opened and closed position.

9 Claims, 11 Drawing Figures

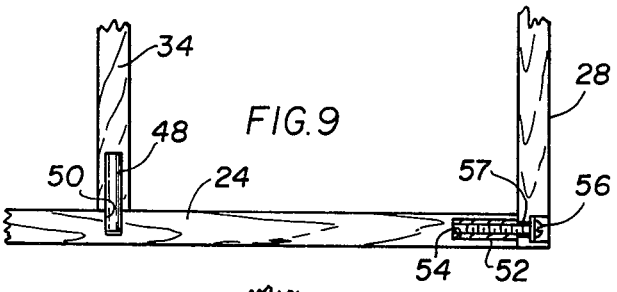
FIG.9
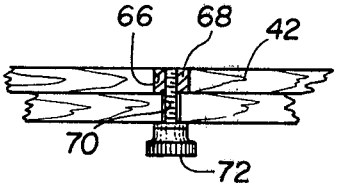
FIG.10
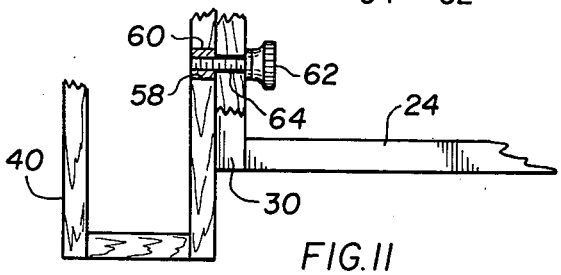
FIG.11
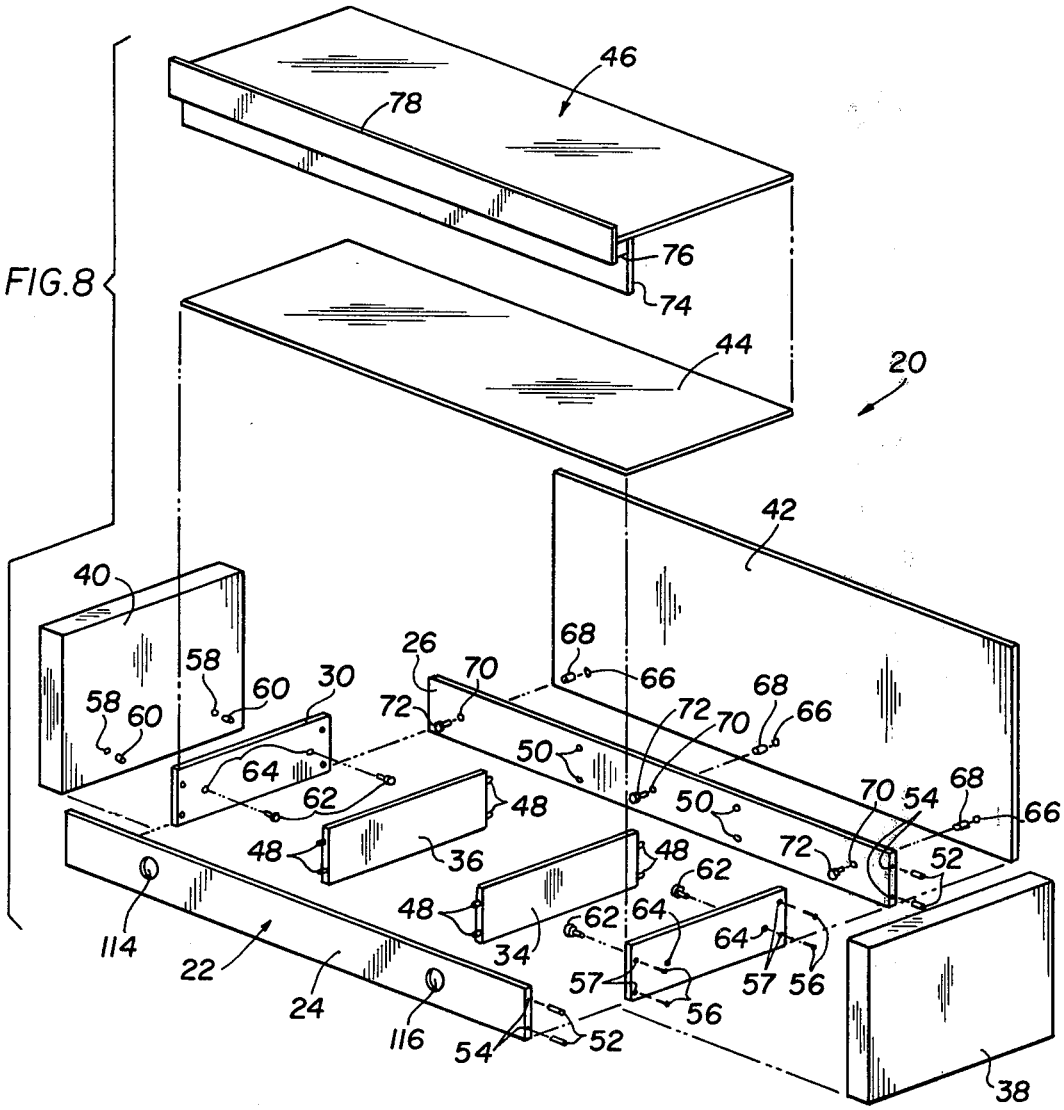

CONVERTIBLE SOFA AND METHOD FOR ASSEMBLING AND DISASSEMBLING SAME

BACKGROUND OF THE INVENTION

1. Field of the Invention

This invention relates generally to convertible sofa beds and more particularly to an improved assemblable and disassemblable convertible sofa bed wherein after assembly, the fasteners used therein are concealed.

2. Description of the Prior Art

It is a common practice to ship furniture fully assembled. When so shipped, it is apparent that the volume of the shipping container is large when compared to the weight of the article of furniture. Since shipping costs, in part, are a function of volume, it is advantageous to reduce this volume. Further, with ever increasing material costs, it would be equally advantageous to reduce package size and effect savings in the material needed to fabricate the shipping container or package. Then again, reducing package size increases handling ease and reduces the probability of damage.

Of course, these advantages have long been recognized so for these and other reasons, several prior apparatuses have been devised to utilize the many inherent benefits stemming from furniture that is easily knocked, or broken down. However, with much of the prior knocked or broken-down furniture, little or no attempt was made to conceal the fasteners used in the assembly of the furniture. Particulary with regard to convertible sofa beds, it has not heretofore been practical to fabricate a convertible sofa bed such that it may be shipped in the knocked down condition and yet be readily assemblable and disassemblable with concealed fasteners.

The present invention overcomes the inherent short comings in prior art knocked-down furniture and specifically provides an improved convertible sofa bed that may be readily assembled and disassembled using fastener means that are concealed after assembly.

SUMMARY OF THE INVENTION

The present invention utilizes the fastener means disclosed in my issued U.S. Pat. No. 3,951,558 granted on Apr. 20, 1976, and which is incorporated herein by reference. Briefly, my aforementioned issued patent discloses an externally and internally threaded metallic insert that is arranged to be positioned in one of the two members that are to be joined. A screw passes through the other member to be joined and matingly engages the internal threads of the insert. As applied to the convertible sofa bed comprising the present invention, the structure disclosed in my aforementioned U.S. patent provides a metallic insert having internal and external threads that is positioned in one of the two members that are to be joined while a screw passes through the other member that is to be joined and matingly engages the internal threads of the metallic insert. More specifically, the structure disclosed in my aforementioned issued U.S. Patent is used to join several portions of the base assembly of the convertible sofa comprising the present invention. The same fasteners are used for securing arm rests to the base assembly and a back wall to the base assembly.

In the present invention a sliding board is positioned over the top wall of the base assembly. The sliding board may be moved manually from the closed position of the sofa bed to the opened position of the sofa bed and back again to the closed position. Alternatively, hydraulic means may be used to automatically move the sliding board between the open and closed positions of the sofa bed.

Accordingly, it is an object of the present invention to provide an improved convertible sofa bed that is readily assemblable and disassemblable.

It is another object of the present invention to provide improved method for assembling and disassembling a knocked-down, convertible sofa bed.

Yet another object of the present invention is to provide an improved assemblable and disassemblable convertible sofa bed, as described above, wherein the fastener means used therein are completely concealed after assembly.

A still further object of the present invention is to provide means for automatically opening and closing the assemblable and disassemblable, convertible sofa bed described hereinabove.

A still further object of the present invention is to provide means for manually opening and closing the assemblable and disassemblable, convertible sofa bed described hereinabove.

The above description, as well as further objects, features and advantages of the present invention, will be more fully appreciated by reference to the following more detailed description of a presently preferred, but nonetheless illustrative embodiment in accordance with the present invention when taken in conjunction with the accompanying drawings.

BRIEF DESCRIPTION OF THE DRAWINGS

In the drawings, wherein the same reference numerals denote the same elements throughout the several views:

FIG. 8 is an exploded, perspective view illustrating the components utilized in the manual or non-automatic embodiment of the present invention;

FIG. 9 is a fragmentary sectional plan view illustrating a typical corner construction of the base assembly comprising the present invention;

FIG. 10 is a fragmentary sectional plan view illustrating the application of fastener means for securing the back wall to the base assembly; and FIG. 11 is a fragmentary plan view, partially in section illustrating fastener means that may be employed for securing the arm rests to the base assembly.

DESCRIPTION OF THE PREFERRED EMBODIMENT

Figure 1:
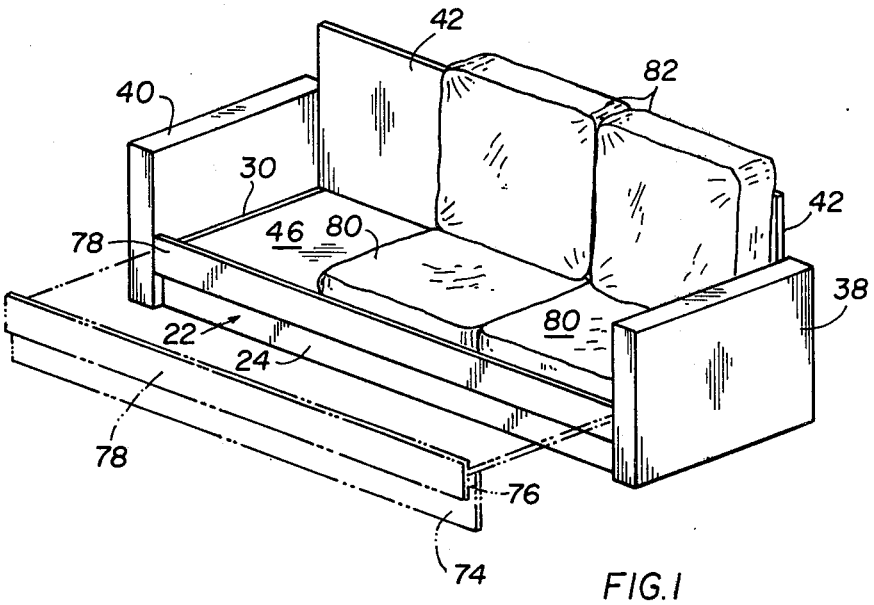
FIG. 1 is a perspective view of the assemblable and disassemblable, convertible sofa bed comprising the present invention with several cushions removed for purposes of illustration and with a portion of the sofa bed shown in phantom outline in the extended or opened condition.
Figure 2:
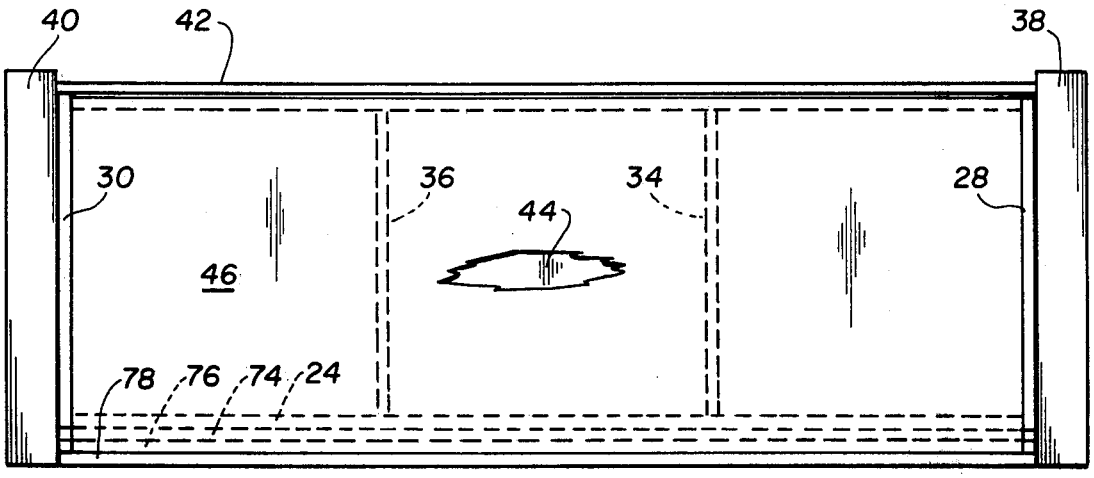
FIG. 2 is a plan view of the assembled convertible sofa bed comprising the present invention with the cushions removed for clarity.
Figure 3:
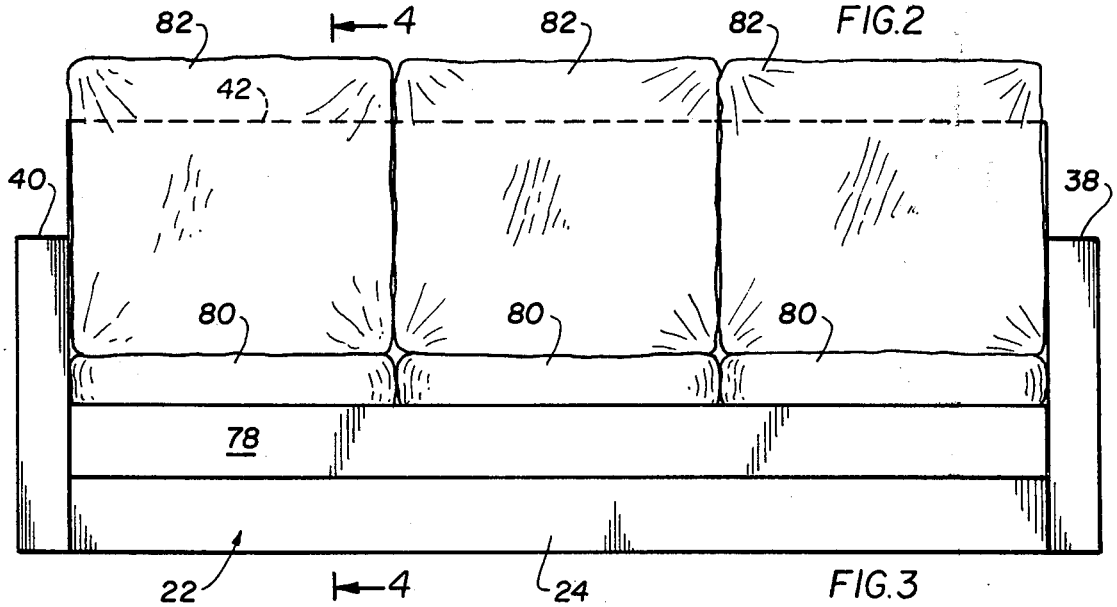
FIG. 3 is a front elevational view of the convertible sofa bed comprising the present invention with the cushions shown in place.

Referring first to FIG. 8, it will be seen that the assemblable and disassemblable convertible sofa bed 20 comprising the present invention includes a base assembly generally designated by the reference character 22 that in turn comprises front and rear walls 24, and 26, respectively, right and left hand side walls 28 and 30, respectively, and a plurality of connecting walls 34 and 36 that extend between the front and rear walls 24 and 26, respectively. The convertible sofa bed 20 further comprises right and left arm rests 38 and 40, respectively, a back wall 42, a top wall 44 and a sliding board assembly that is generally designated by the reference character 46.

The connecting walls 34 and 36 are secured to the front and rear walls 24 and 26 utilizing dowel pins 48 that are integral with the connecting walls 34 and 36 and which engage suitably positioned and sized blind holes 50 formed in the confronting faces of the front and rear walls 24 and 26, respectively. Metallic inserts 52 are positioned in bores 54 formed in the end faces of the front and rear walls 24 and 26 in a manner taught by aforementioned issued patent. Screws 56 that pass through holes 57 may then be employed for securing the right and left hand side walls 28 and 30, respectively, to the front and rear walls 24 and 26, respectively.

The arm rests 38 and 40 are also provided with blind holes 58 for receiving metal inserts 60 such as taught in my aforementioned U.S. Patent. Screws 62 pass through suitably positioned openings 64 in the side walls 28 and 30 in order to secure the arm rests 38 and 40 to the base assembly 22.

Similarly, blind holes 66 are formed in the back wall 42 in order to receive metallic inserts 68 such as taught by aforementioned U.S. patent. Suitably positioned holes 70 are formed in the rear wall 26 in order to receive fasteners such as screws 72 for joining the back wall 42 to the base assembly 22.

It should be noted at this time that the upper edge of the side walls 28 and 30 of the base assembly 22 are positioned in a first plane that is common with the upper edge of the connecting walls 34 and 36. The upper edges of the front and rear walls 24 and 26, respectively, are positioned in a second common plane that is below the first common plane to thereby define a recess for receiving the top wall 44. In addition, it should be further noted that the upper surface of the sliding board assembly 46 is in the first common plane and is substantially flush with the upper edges of the side walls 28 and 30 so that the side walls 28 and 30 define guide means for the sliding board assembly 46 during the movement thereof as will be explained more fully hereinafter.

The sliding board assembly 46 is comprised of a forward wall 74, a spacer 76, and a transverse bar 78. Although not specifically illustrated, it should be understood that the sliding board assembly 46 may be assembled using fasteners such as taught in my aforementioned issued patent that extend from the back of the forward wall 74 through the spacer 76 into the bar 78. It should also be noted that the bar 78 extends slightly above the upper surface of the sliding board assembly 46 as well as slightly below the spacer and in spaced relationship with the forward wall 74. The upper extension of the bar 78 may be used to retain a cushion 80 while the lower extension of the bar 78 is grippable by hand for opening and closing the sofa bed 20 as will now be described in connection with one embodiment of the invention.

Figure 5:
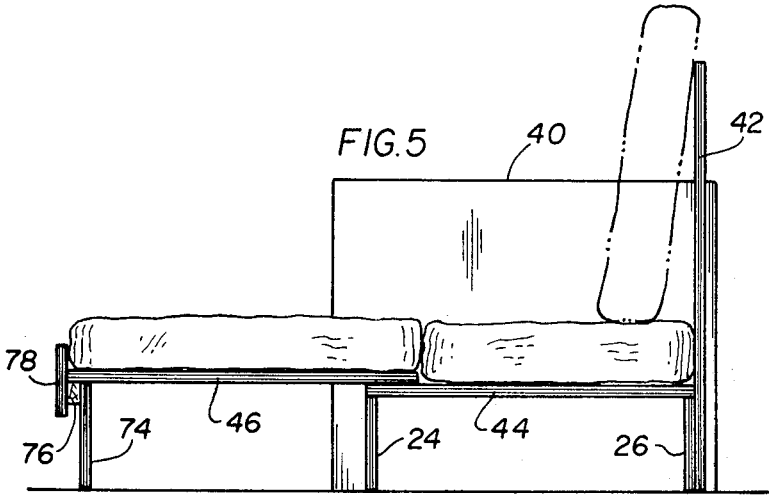
FIG. 5 is a sectional elevational view, similar to FIG. 4, showing the convertible sofa bed comprising the present invention in the opened condition as a result of the manual mode of operation.
Figure 4:
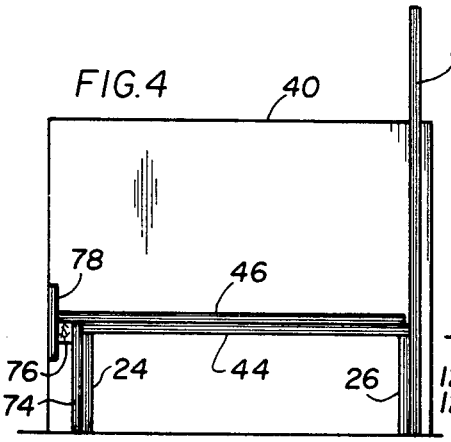
FIG. 4 is a sectional elevational view taken along line 4—4 of FIG. 3.
Figure 6:
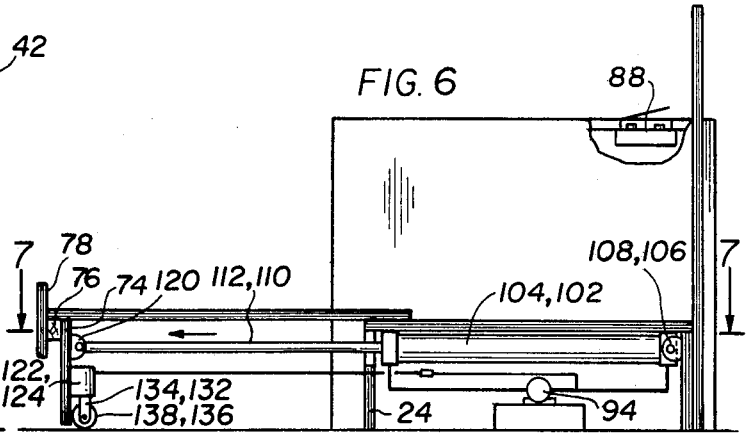
FIG. 6 is a sectional elevational view, partially broken away, illustrating apparatus for automatically opening and closing the sofa bed as opposed to the manual mode of operation of the embodiment shown in FIG. 5.
Figure 7:
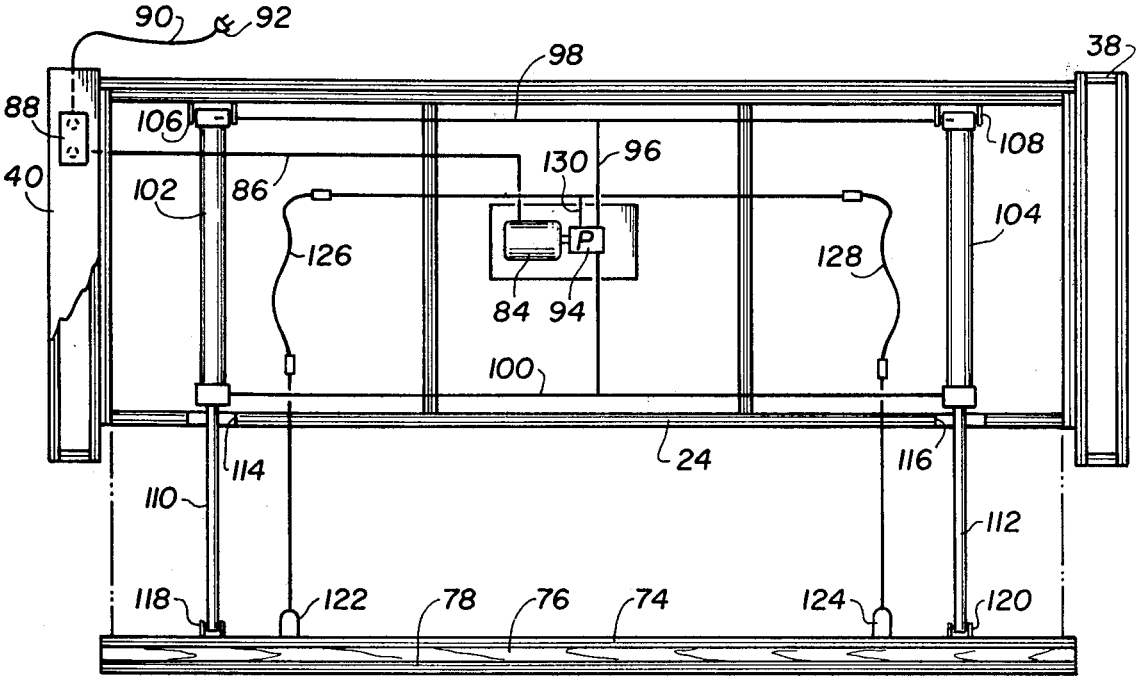
FIG. 7 is a sectional plan view taken along line 7—7 of FIG. 6.

In a manual mode of operation, the sofa 20 is converted into a double bed by first removing the back and bottom cushions 80 and 82, respectively. The sliding board assembly 46 is lifted slightly utilizing the bar 78 to space the bottom edge of the forward wall 74 away from the floor surface on which it rests and is then pulled forward to the position shown in phantom outline in FIG. 1 and in solid outline in FIG. 5. The cushions 80 and 82 may then be used as the mattress. To convert the double bed back into a sofa, the steps set forth above are merely reversed.

In an alternative embodiment of the present invention, the sofa may be converted to a double bed automatically using hydraulic means. Towards this end an electric motor 84 that is adapted to be connected to a suitable source of current is provided. The motor 84, which is advantageously reversible, is coupled by means of a line 86 to a suitable switch 88 that is, in turn, provided with a line 90 and a male plug 92. An hydraulic pump 94 is coupled to and driven by the motor 84 and is fluidly connected, by means of conduits 96, 98, and 100 to the body portions 102, and 104 of conventional hydraulic cylinders. The body portions 102 are mounted, by means of brackets 106 and 108, to the rear wall 26 of the base assembly 22. The pistons 110 and 112 that slide within the body portions 102 and 104, respectively, pass through apertures 114 and 116 in the front wall 24 and are coupled, by means of brackets 118 and 120 to the forward wall 74. A second set of hydraulic cylinders 122 and 124 are also mounted on the forward wall 74 and are fluidly coupled to the pump 94 by means of conduits 126, 128 and 130. The pistons 132 and 134 of the cylinders 122 and 124 are provided with wheels 136 and 138, respectively, which wheels are normally spaced from the floor surface when not being used to either open or close the sofa.

In the automatic mode of operation, the plug 92 is coupled to the source of electrical energy and the switch 88 is closed. The electric motor 84 and the pump 94 are thereby activated. This causes the pistons 132 and 134 of the cylinders 122 and 124 to cause the wheels 136 and 138 to engage the floor thereby lifting the lower edge of the forward wall 74 up off the floor. The pistons 110 and 112 on the cylinders 102 and 104 then push the sliding board assembly 46 forward so that the cushions 80 and 82 may then be set in place as a double bed. To convert the double bed back to a sofa, the foregoing steps are reversed.

From the foregoing, it will be appreciated that a low cost, improved convertible sofa bed has been provided and which may be shipped in the knocked-down condition but which is readily assemblable and disassemblable. In the assembled condition the fasteners used for joining the several components comprising the sofa bed are concealed by utilizing fastener means such as disclosed in my aforementioned U.S. Patent.

While there have been shown and described and pointed out the fundamental novel features of the invention as applied to preferred embodiments thereof, it will be understood that various omissions and substitutions and changes in the form and details of the device illustrated and in its operation and method of assembly, may be made by those skilled in the art without departing from the spirit of the invention. It is the intention, therefore, to be limited only as indicated by the scope of the claims appended hereto.

What is claimed is:

1. An assemblable and disassemblable furniture as a convertible sofa comprising:

a base assembly including spaced apart front and rear walls, spaced apart side walls, connecting wall means positioned inwardly of said side walls and a planar top wall, said connecting walls extending between said front and said rear walls;

first fastener means for removably securing said side walls of said base assembly to said front and said rear walls of said base assembly;

arm rests mounted on said side walls externally thereof, whereby said first fastener means are concealed;

second fastener means for removably securing said side walls of said base assembly to said arm rests, said second fastener means extending in an outward direction from a position inside of said side walls without completely passing through said arm rests and being concealed by said top wall of said base assembly;

a back wall mounted on said rear wall of said base assembly;

third fastener means for removably securing said rear wall of said base assembly to said back wall, said third fastener means extending in an outward direction from a position inside of said rear wall of said base assembly without passing completely through said back wall and being concealed by said top wall of said base assembly;

a planar sliding board assembly slidable in planar overlying engaging relation with said top wall and having a rear edge that is positioned adjacent said back wall when said sofa is in the closed condition with a portion of said sliding board assembly being movable to a position wherein said rear edge thereof is spaced from said back wall to thereby define the opened condition of said sofa;

and displacing means for moving said sliding board assembly between said closed and said opened condition.

2. A sofa according to claim 1 wherein the upper edge of said side walls of said base assembly are positioned in a first plane that is common with the upper edge of said connecting walls, the upper edge of said front and said rear walls of said base assembly being positioned in a second common plane that is below that of said first common plane to thereby define a recess for receiving said top wall of said base assembly.

3. A sofa according to claim 2 wherein the upper surface of said sliding board assembly is in said first common plane and is substantially flush with the upper edges of said side walls of said base assembly whereby said side walls of said base assembly define guide means for said sliding board assembly during the movement thereof.

4. A sofa according to claim 1 wherein said displacing means comprises a forward wall mounted proximate the forward edge of said sliding board in superimposed relationship with said front wall of said base assembly and a bar secured to said forward wall with a portion of said bar being grippable by hand whereby said sliding board assembly may be moved between the opened and the closed positions.

5. A sofa according to claim 4 wherein a portion of said bar extends above the upper surface of said sliding board and defines means for retaining a cushion.

6. A sofa according to claim 1 wherein said displacing means comprises a forward wall mounted on the forward edge of said sliding board assembly, an electric motor, switch means for connecting said electric motor to a source of current, an hydraulic pump driven by said motor, first and second hydraulic cylinder means fluidly coupled to said pump and driven thereby, said first hydraulic cylinder means having the body portions thereof secured to said base assembly and the pistons thereof coupled to said forward wall, said second hydraulic cylinder means having wheels on the pistons thereof, the body portions of said second hydraulic cylinders being mounted on said forward wall whereby when said pump is driven by said electric motor, said second hydraulic cylinder lowers said wheels into rolling engagement with the floor to thereby lift the lower edge of said forward wall out of contact with the floor and said first hydraulic cylinder means move said sliding board assembly between the opened and the closed positions.

7. A sofa according to claim 6 wherein said forward wall further includes a bar having a portion thereof that extends above the upper surface of said sliding board and defines means for retaining a cushion.

8. A method for assembling a convertible sofa comprising the steps of:

forming a base assembly that includes spaced apart front and rear walls, a pair of spaced apart side walls, and a first plurality of fastener means for securing the ends of the side walls to the ends of the front and rear walls;

securing arm rests to the side walls utilizing a second plurality of fastener means whereby the first plurality of fastener means is concealed;

mounting a back wall on the rear wall of the base assembly by means of a third plurality of fastener means;

positioning a top wall on the base assembly to thereby conceal the second and third plurality of fastener means;

and locating a sliding board assembly in superimposed relationship over the top wall with the sliding board assembly being movable between the opened and closed positions of the convertible sofa.

9. A method according to claim 9 wherein there is further included the steps of:

mounting switch means, an electric motor and an hydraulic pump on the convertible sofa whereby the motor is adapted to be connected to a source of current, the switch is arranged to start and stop the motor and the pump is driven by the motor when the motor is running;

fluidly coupling first hydraulic cylinder means to the pump whereby the pistons of the first hydraulic cylinder means are arranged to move the sliding board assembly between the opened and the closed position of the convertible sofa;

and mounting second hydraulic cylinder means having wheels on the sliding board whereby when the pump is driven by the motor the wheels of the second hydraulic cylinder means will engage the floor to thereby lift the sliding board assembly off the floor and thereby facilitate movement of the sliding board.

* * * * *

UNITED STATES PATENT OFFICE
CERTIFICATE OF CORRECTION

Patent No. 4,067,073 Dated January 10, 1978

Inventor(s) Anatoli N. Komarov

It is certified that error appears in the above-identified patent and that said Letters Patent are hereby corrected as shown below:

Claim 9, line 1,"claim 9" should read -- claim 8 --.

Signed and Sealed this

Eighteenth Day of April 1978

[SEAL]

*Attest:*

RUTH C. MASON
*Attesting Officer*

LUTRELLE F. PARKER
*Acting Commissioner of Patents and Trademarks*